US007946380B2

(12) United States Patent
Yamamoto et al.

(10) Patent No.: US 7,946,380 B2
(45) Date of Patent: May 24, 2011

(54) MOTORCYCLE AND MUFFLER STRUCTURE

(75) Inventors: Masanori Yamamoto, Iwata (JP); Shigeyuki Matsuura, Iwata (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 207 days.

(21) Appl. No.: 12/262,469

(22) Filed: Oct. 31, 2008

(65) Prior Publication Data

US 2009/0120716 A1 May 14, 2009

(30) Foreign Application Priority Data

Oct. 31, 2007 (JP) ..... 2007-284231

(51) Int. Cl.
*F01N 13/00* (2010.01)
*F02B 77/11* (2006.01)
*F01N 13/14* (2010.01)

(52) U.S. Cl. ..... 181/227; 181/204; 181/282

(58) Field of Classification Search ..... 181/227, 181/228, 241, 247, 248, 282, 204, 205
See application file for complete search history.

(56) References Cited

U.S. PATENT DOCUMENTS 3,237,716 A * 3/1966 Parsons ..... 181/243
3,677,364 A * 7/1972 Pawlina ..... 181/269
4,609,067 A * 9/1986 Gonwa ..... 181/211
5,036,947 A * 8/1991 Metzger ..... 181/241
5,388,408 A * 2/1995 Lawrence ..... 60/324
5,474,123 A * 12/1995 Buckshaw ..... 165/134.1
5,907,135 A * 5/1999 Hayakawa et al. ..... 181/282
6,438,949 B1 * 8/2002 Nozaki ..... 60/322
2005/0161283 A1 * 7/2005 Emler ..... 181/249
2006/0000668 A1 * 1/2006 Yamaguchi et al. ..... 181/249
2006/0042871 A1 * 3/2006 Yasuda et al. ..... 181/227

FOREIGN PATENT DOCUMENTS

JP 2005-105959 4/2005

OTHER PUBLICATIONS

Translation of JP 2005-105959 A; http://www4.ipdl.inpit.go.jp/Tokujitu/tjsogodbenk.ipdl.*

* cited by examiner

*Primary Examiner* — Elvin Enad
*Assistant Examiner* — Jeremy Luks
(74) *Attorney, Agent, or Firm* — Keating & Bennett, LLP

(57) ABSTRACT

A motorcycle has a muffler 40, a muffler cover 50 for covering a part of a side surface (outer peripheral surface) of the muffler 40 and an end cap 60 for covering the muffler 40 from a rear side thereof. The end cap 60 is separately formed from the muffler cover 50 and disposed away from the muffler cover 50. The muffler cover 50 is mounted on the muffler 40 in a manner such that a central axis of the muffler cover 50 is offset from a central axis of the muffler 40 in a radial direction.

9 Claims, 9 Drawing Sheets

MOTORCYCLE AND MUFFLER STRUCTURE

This application claims priority under 35 U.S.C. §119 to Japanese Patent Application No. 2007-284231 filed on Oct. 31, 2007, the entire disclosure of which is incorporated herein by reference in its entirety.

BACKGROUND OF THE INVENTION

1. Field of the Invention

The preferred embodiments of the present invention relate, inter alia, to a motorcycle equipped with a muffler cover, and a muffler structure having a muffler cover for covering a muffler disposed on a side of a rear wheel of a motorcycle.

2. Description of the Related Art

The following description sets forth the inventors' knowledge of related art and problems therein and should not be construed as an admission of knowledge in the prior art.

In motorcycles, a muffler is generally disposed on a side of a rear wheel for, e.g., reducing exhaust sound. In some motorcycles, a side surface of the muffler is partially covered by a muffler cover of an arc-shape in cross section. Japanese Unexamined Laid-open Patent Publication No. 2005-105959 discloses a motorcycle. In this motorcycle, the central axis of the muffler cover is offset to the outside of the central axis of the muffler in the vehicle width direction with a clearance between the muffler cover and the muffler. A rear cover for covering the muffler from the rear side is integrally formed with the muffler cover so that the muffler cover and the muffler can have a unitary external appearance when the entire muffler is viewed either from the rear side or obliquely from the rear side of the motorcycle.

However, there is a problem with the conventional structure of the aforementioned muffler cover that the muffler cover and the rear cover are integrally formed and thus heat of the muffler is not smoothly released to the outside of the muffler cover.

The description herein of advantages and disadvantages of various features, embodiments, methods, and apparatus disclosed in other publications is in no way intended to limit the present invention. For example, certain features of the preferred embodiments of the invention may be capable of overcoming certain disadvantages and/or providing certain advantages, such as, e.g., disadvantages and/or advantages discussed herein, while retaining some or all of the features, embodiments, methods, and apparatus disclosed therein.

SUMMARY OF THE INVENTION

The preferred embodiments of the present invention have been developed in view of the above-mentioned and/or other problems in the related art. The preferred embodiments of the present invention can significantly improve upon existing methods and/or apparatuses.

Among other potential advantages, some preferred embodiments of the present invention can provide a motorcycle capable of smoothly releasing heat of a muffler to an outside of a muffler cover.

According to a first aspect of the preferred embodiment of the present invention, a motorcycle includes a cylindrically shaped muffler disposed at a side of a rear wheel, a muffler cover having an arc cross-sectional shape corresponding to an outer shape of the muffler, the muffler cover being configured to cover at least a part of a side surface of the muffler, and an end cap formed separately from the muffler cover and disposed away from the muffler cover so as to cover the muffler from a rear side of the muffler. The muffler cover is mounted on the muffler in a manner such that a central axis of the muffler cover is offset from a central axis of the muffler in a radial direction.

In accordance with this motorcycle, the central axis of the muffler cover is offset from the central axis of the muffler in the radial direction. This facilitates obtainment of the gap between the muffler and the muffler cover, thereby improving heat dissipation of the muffler. The muffler cover and the end cap are separately formed, and thus heat dissipation of the muffler can be further improved.

According to a second aspect of the preferred embodiment of the present invention, a muffler structure for a motorcycle includes a cylindrical muffler to be disposed at a side of a rear wheel of the motorcycle, a muffler cover having an arc cross-sectional shape corresponding to an outer shape of the muffler, the muffler cover being configured to cover at least a part of a side surface of the muffler, and an end cap formed separately from the muffler cover and disposed away from the muffler cover so as to cover the muffler from a rear side of the muffler. The muffler cover is mounted on the muffler in a manner such that a central axis of the muffler cover is offset from a central axis of the muffler in a radial direction.

In accordance with this muffler structure, the same effects as mentioned above can be obtained.

The above and/or other aspects, features and/or advantages of various embodiments will be further appreciated in view of the following description in conjunction with the accompanying figures. Various embodiments can include and/or exclude different aspects, features and/or advantages where applicable. In addition, various embodiments can combine one or more aspect or feature of other embodiments where applicable. The descriptions of aspects, features and/or advantages of particular embodiments should not be construed as limiting other embodiments or the claims.

BRIEF DESCRIPTION OF THE DRAWINGS

The preferred embodiments of the present invention are shown by way of example, and not limitation, in the accompanying figures, in which.

DETAILED DESCRIPTION OF THE PREFERRED EMBODIMENTS

In the following paragraphs, some preferred embodiments of the invention will be described by way of example and not limitation. It should be understood based on this disclosure that various other modifications can be made by those in the art based on these illustrated embodiments.

Hereinafter, an embodiment of the present invention will be described with reference to the attached drawings.

Figure 1:
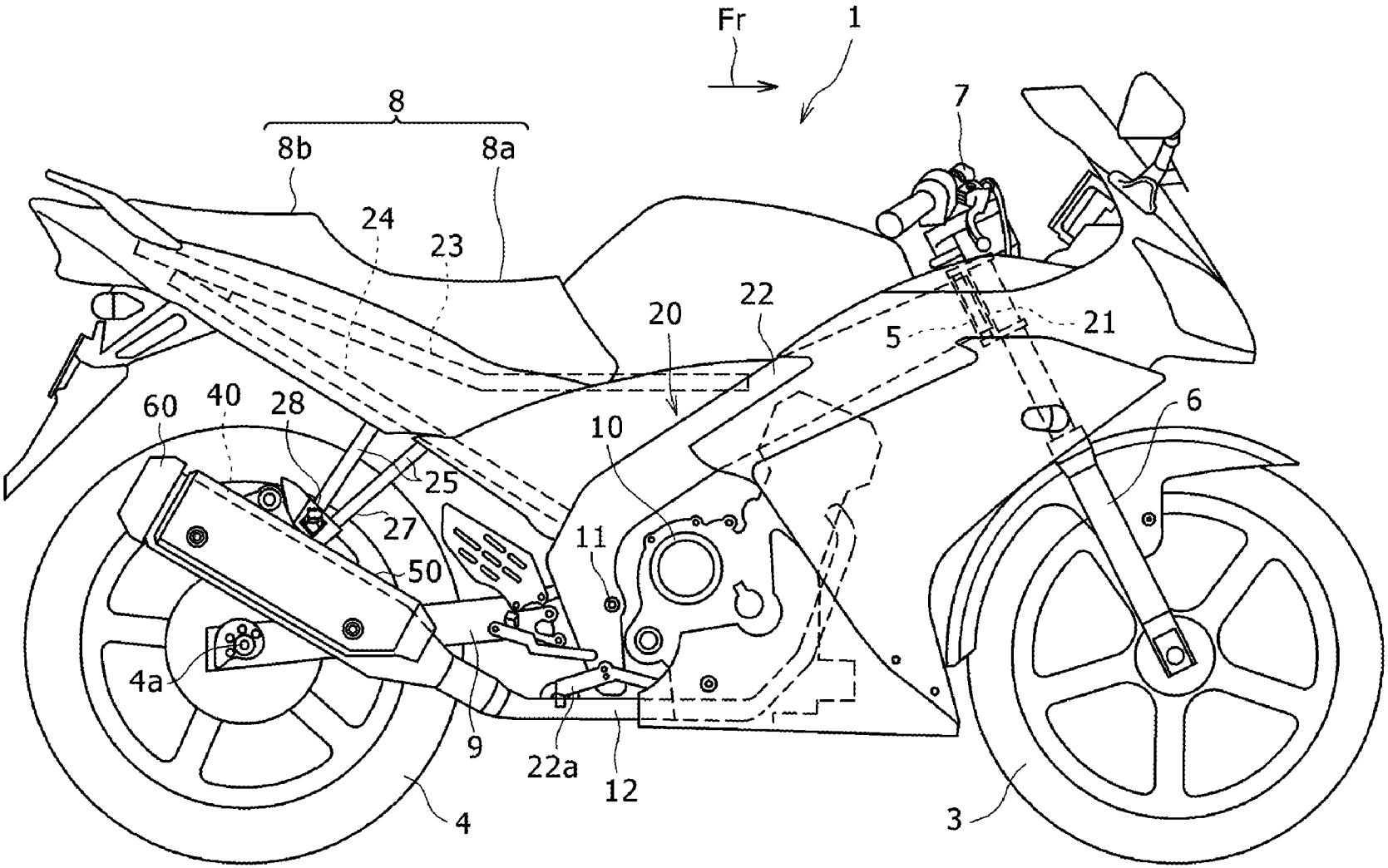
FIG. 1 is a side view of a motorcycle according to an embodiment of the present invention.
Figure 2:
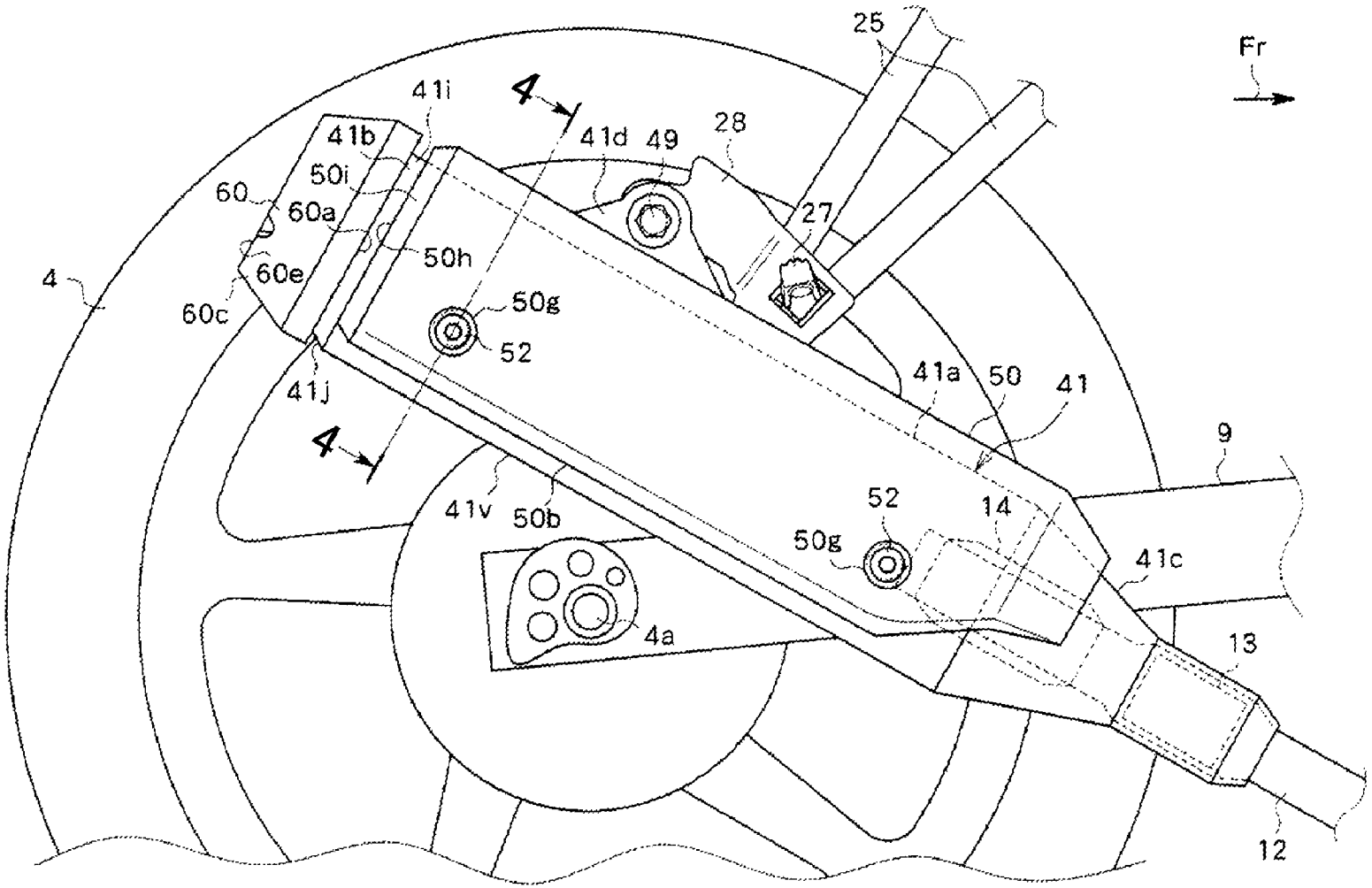
FIG. 2 is a side view of a muffler of the motorcycle and the vicinity thereof.
Figure 3:
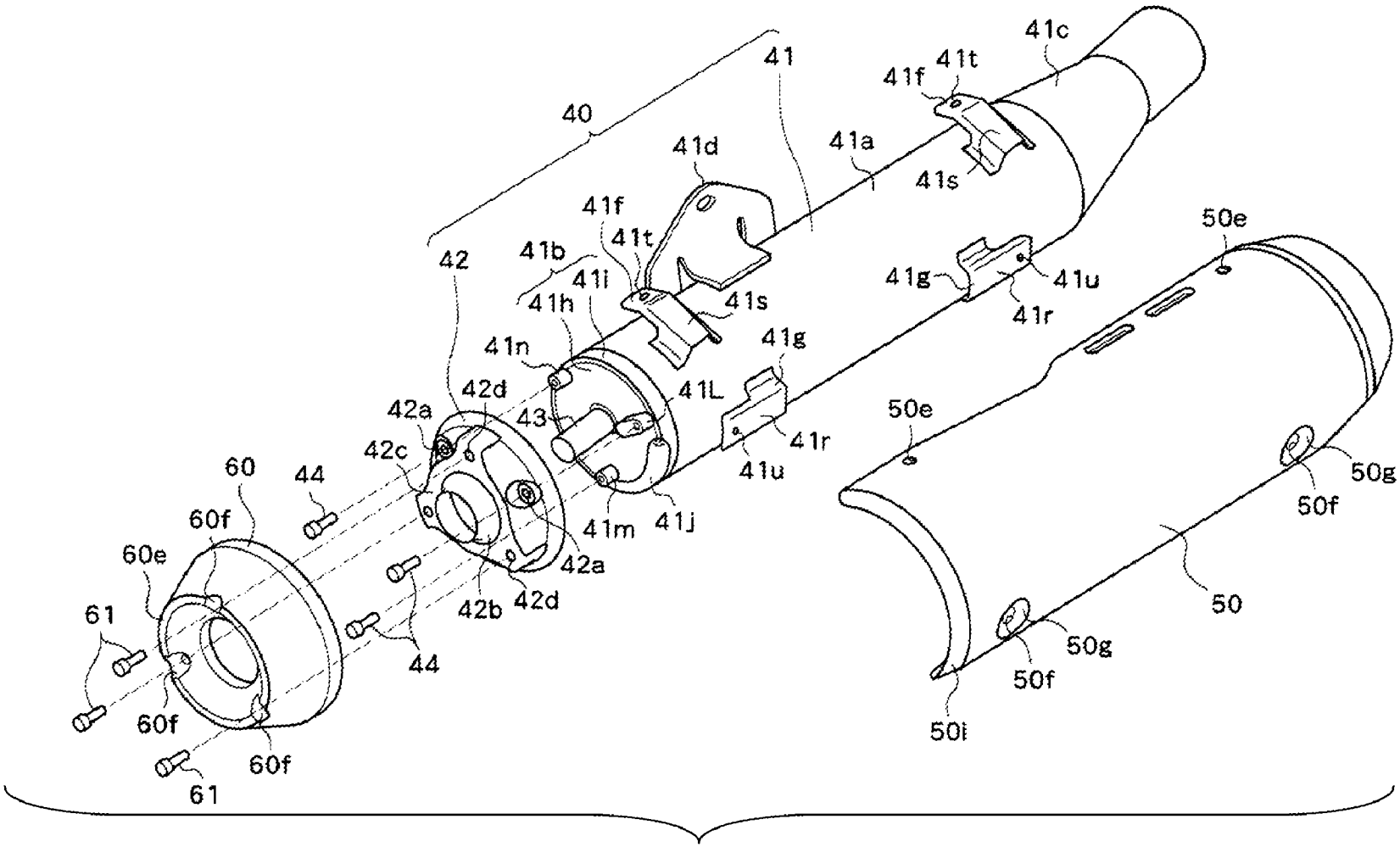
FIG. 3 is an exploded perspective view showing the muffler, a muffler cover, and an end cap of the motorcycle.

FIG. 1 is a side view of a motorcycle 1 according to an embodiment of the present invention. FIG. 2 is a side view of a muffler 40 mounted on the motorcycle 1 and the vicinity thereof. FIG. 3 is an exploded perspective view of the muffler 40, a muffler cover 50, and an end cap 60.

As shown in FIG. 1, the motorcycle 1 includes, in addition to the muffler 40, the muffler cover 50 and the end cap 60, a front wheel 3, a rear wheel 4, an engine 10, and a vehicle body frame 20. The vehicle body frame 20 includes a head pipe 21, a main frame 22, and seat rails 23, and back stays 24.

The head pipe 21 is provided at a front end of the vehicle body frame 20 and rotatably supports a steering shaft 5 extending obliquely to the vertical direction. The steering shaft 5 is connected to a front fork 6 via two brackets 15 and 15 arranged up and down. A lower end of the front fork 6 supports an axle of the front wheel 3. Handlebars 7 are disposed at the upper portion of the steering shaft 5 and connected to the steering shaft 5 via a bracket (not shown). The handlebars 7 turn to right or left together with the steering shaft 5, the front forks 6, and the front wheel 3 in response to the operation by a rider.

A front end of the main frame 22 is connected to the head pipe 21. The main frame 22 extends obliquely downward from its front end toward the vehicle rear side, and its rear portion bends downward. Front ends of the seat rails 23 are connected to the main frame 22. The seat rails 23 extend rearward from their front ends and support a seat 8 disposed thereon. The seat 8 is the so-called tandem seat, and has a front seat portion 8*a* on which a rider is seated and a rear seat portion 8*b* on which a passenger riding on the motorcycle 1 in the rear of the rider is seated.

Front ends of the back stays 24 are also connected to the main frame 22. The back stays 24 extend obliquely upward from their front ends toward the vehicle rear side. Their rear ends are connected to the seat rails 23. Two stays 25 and 25 extending downward are connected to midway portions of the back stay 24. A bracket 28 is provided at the ends of the stays 25 and 25. A footrest 27 on which a passenger seated on the rear seat portion 8*b* places his/her foot is joined to the bracket 28.

A rear arm 9 extending in the fore-and-aft direction is disposed below the back stays 24. A front end of the rear arm 9 is mounted on a pivot shaft 11 supported by the main frame 22. The rear end of the rear arm 9 supports an axle 4*a* of the rear wheel 4. Driving force outputted from the engine 10 is transmitted to the rear wheel 4 via a chain (not shown).

The engine 10 is disposed below the main frame 22 and suspended by the main frame 22. A front end of an exhaust pipe 12 through which exhaust gas generated due to drive of the engine 10 flows is connected to the engine 10. The exhaust pipe 12 extends downward from its front end along the engine 10, then curves and extends rearward. As shown in FIG. 2, a rear portion of the exhaust pipe 12 is disposed in the muffler 40. The rear end of the exhaust pipe 12 opens in the muffler 40.

Figure 4:
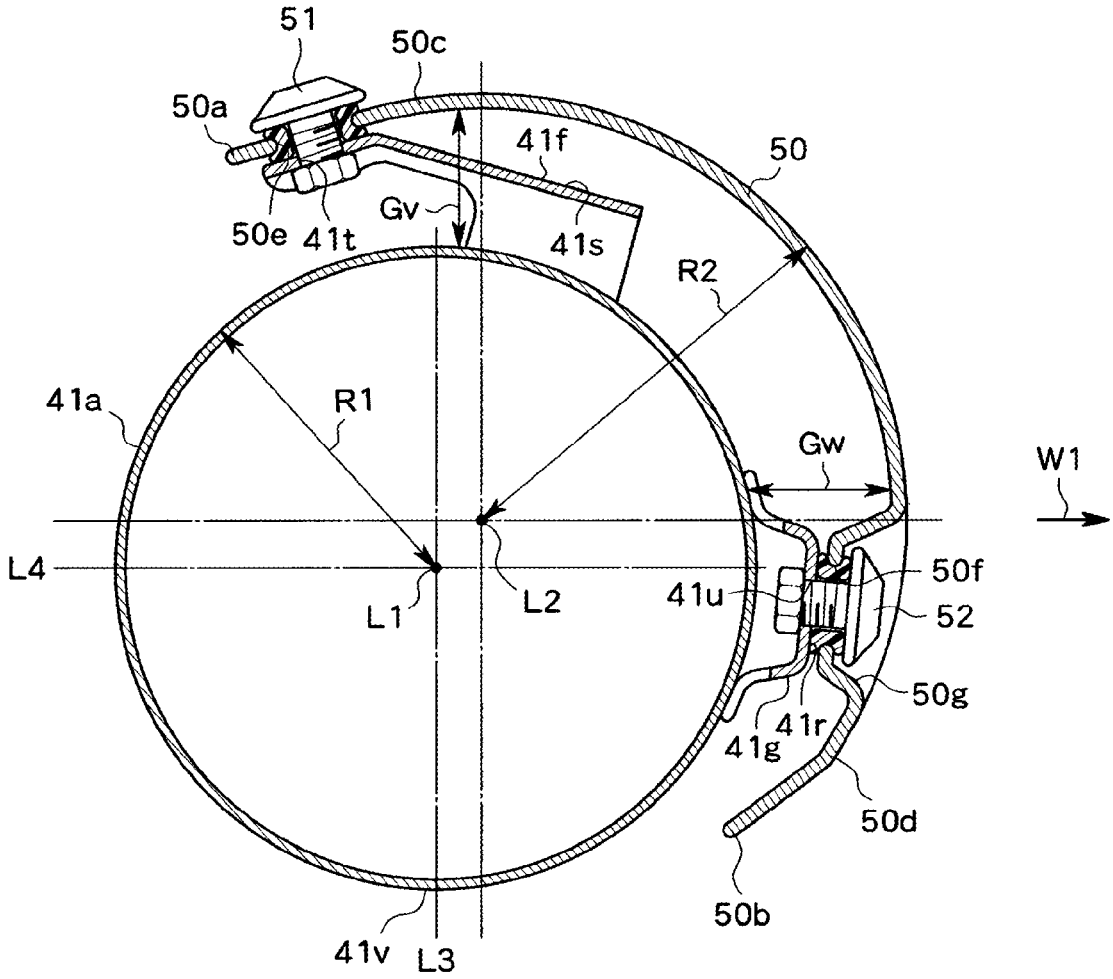
FIG. 4 is an enlarged cross-sectional view taken along the line 4-4 in FIG. 2.
Figure 5:
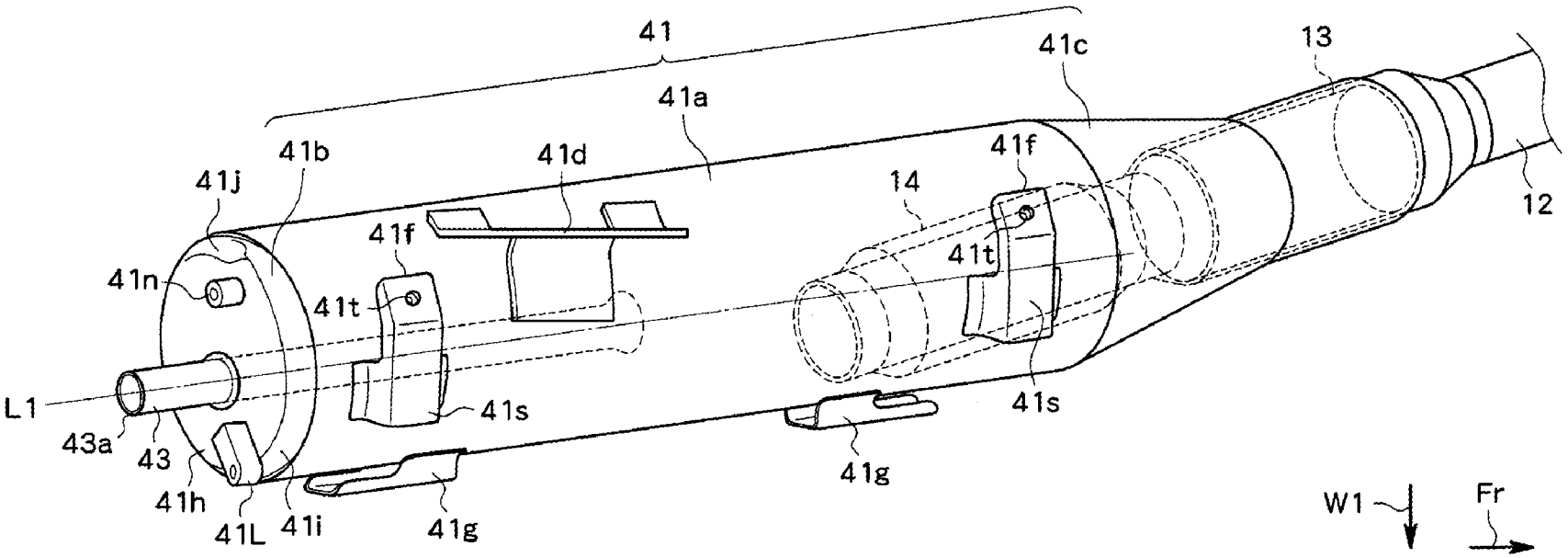
FIG. 5 is a perspective view of a muffler main body forming the muffler.
Figure 6:
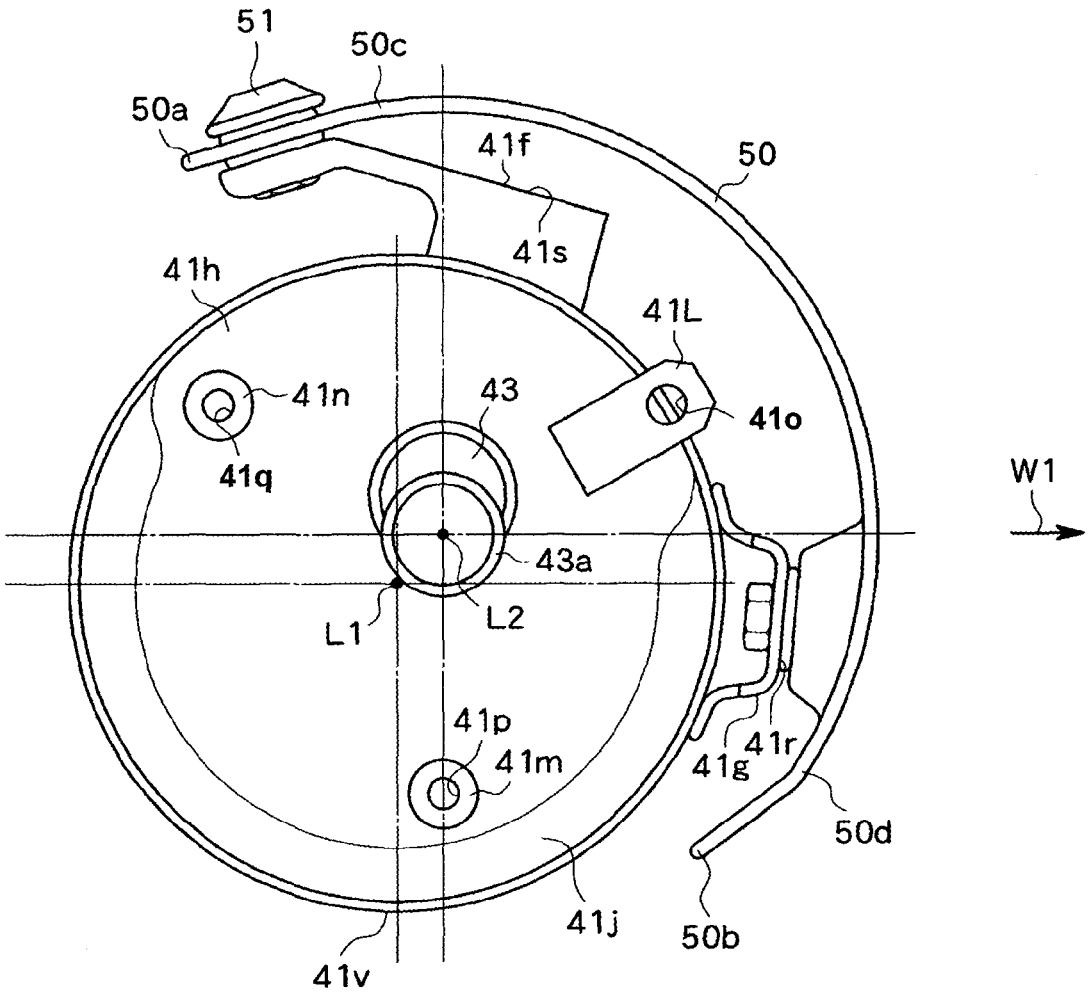
FIG. 6 is a view of the muffler main body and the muffler cover as seen from the rear.
Figure 7:
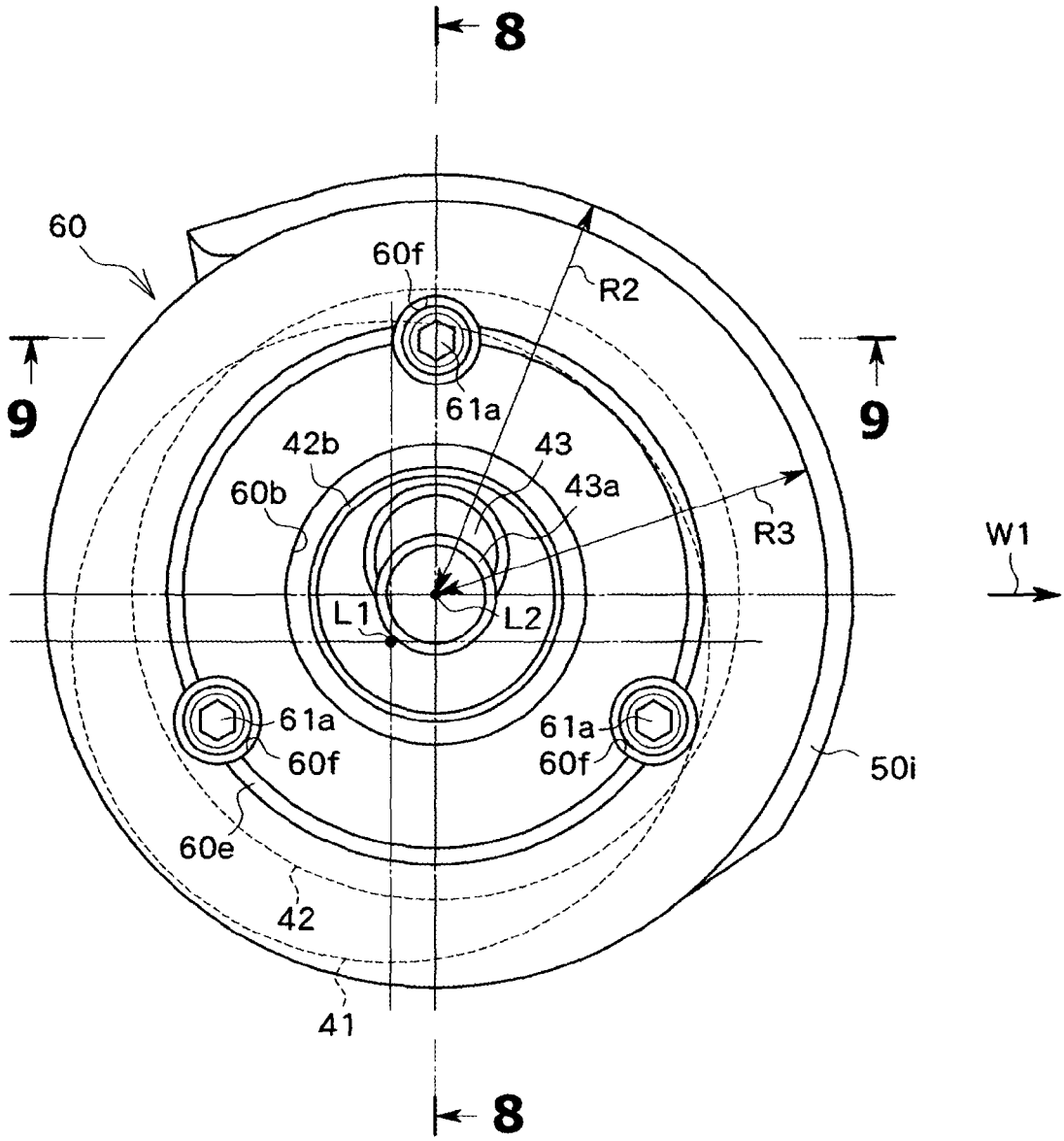
FIG. 7 is a view of the end cap and the muffler cover as seen from the rear.
Figure 8:
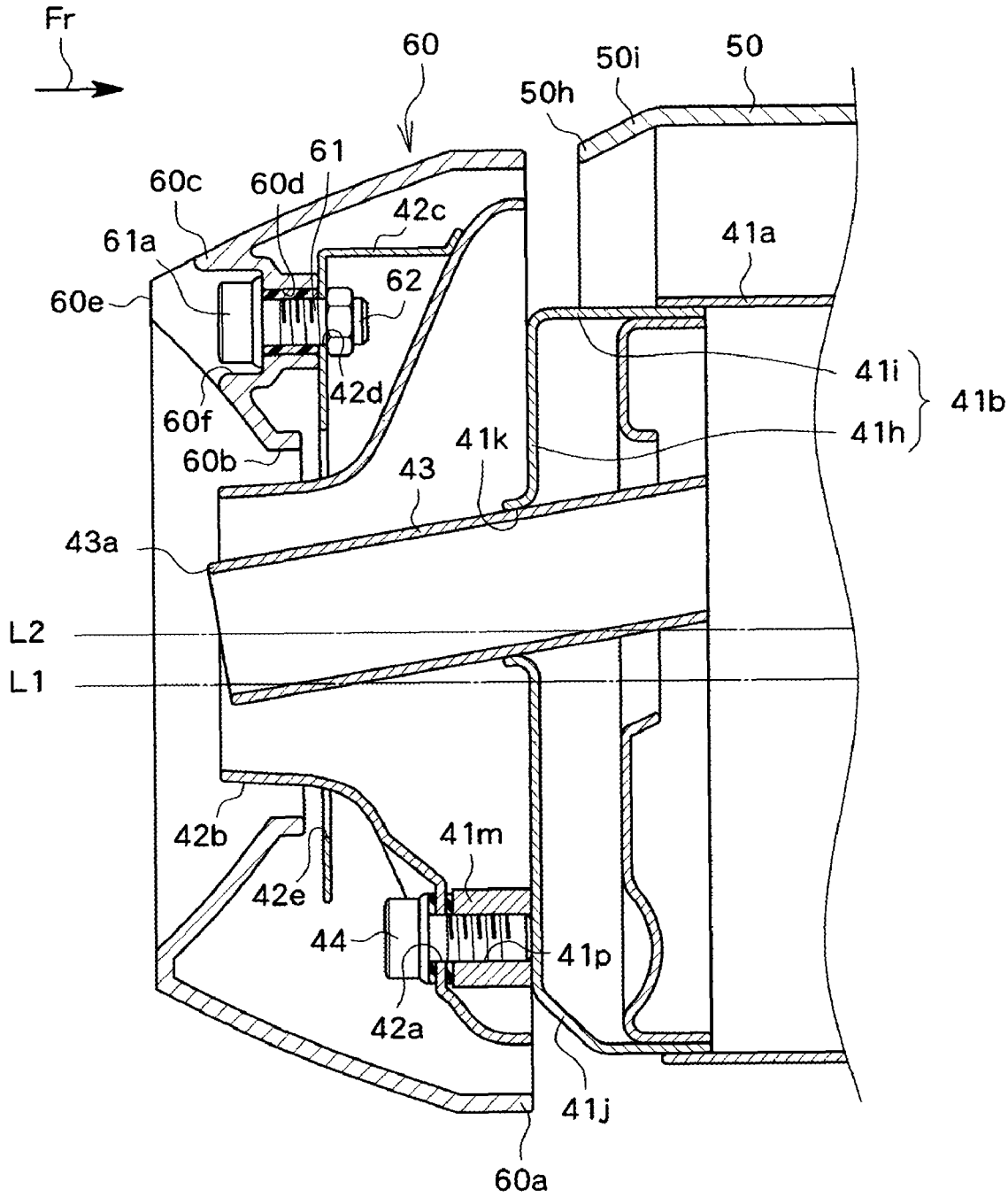
FIG. 8 is a cross-sectional view taken along the line 8-8 in FIG. 7.

Now, the muffler 40, the muffler cover 50, and the end cap 60 will be described in detail. As shown in FIG. 3, the muffler 40 includes a muffler main body 41 and a heat insulating cap 42. FIG. 4 is an enlarged cross-sectional view taken along the line 4-4 in FIG. 2. FIG. 5 is a perspective view of the muffler main body 41. FIG. 6 shows the muffler main body 41 and the muffler cover 50 with the end cap 60 and the heat insulating cap 42 removed as seen from the rear side thereof. FIG. 7 shows the end cap 60 and the muffler cover 50 as seen from the rear side thereof. FIG. 8 is a cross-sectional view taken along the line 8-8 in FIG. 7.

As shown in FIG. 2, the muffler 40 is disposed at the side of the rear wheel 4. The rear portion of the exhaust pipe 12 is disposed in the muffler main body 41. As shown in FIG. 5, a tailpipe 43 is connected to the rear end of the muffler main body 41, so that exhaust gas emitted from the exhaust pipe 12 is discharged rearward of the vehicle through the tailpipe 43. The inside of the muffler main body 41 is defined into a plurality of expansion chambers, so that the exhaust gas emitted from the exhaust pipe 12 is expanded in the expansion chambers, and thereafter discharged from the tailpipe 43. A catalyst 13 is disposed at the rear side of the exhaust pipe 12. A silencer 14 is disposed at the downstream side of the catalyst 13. The silencer 14 is formed by, for example, a perforated metal member formed into a cylindrical shape with a plurality of holes and glass wool wound around its outer periphery. The catalyst 13 and the silencer 14 are positioned in the muffler main body 41.

As shown in FIGS. 3 and 5, the muffler main body 41 includes a cylindrical portion 41*a*, a front lid portion 41*c* for closing the cylindrical portion 41*a* from its front side, a rear lid portion 41*b* positioned at the rear end of the muffler main body 41 for closing the cylindrical portion 41*a* from its rear side.

As shown in FIG. 4, the cylindrical portion 41*a* has a cylindrical shape perfect circular in cross-section. As shown in FIG. 5, the cylindrical portion 41*a* is disposed in a manner such that its central axis L1 extends generally along the vehicle fore-and-aft direction. In this illustrated embodiment, the cylindrical portion 41*a* is disposed obliquely with respect to the vehicle traveling direction (the direction indicated by the arrow Fr) so that its rear side is positioned at the outer side in the vehicle width direction (the direction indicated by the arrow W1) as compared to its front side. Further, as shown in FIG. 2, the cylindrical portion 41*a* is obliquely disposed such that its front side is lower than its rear side.

As shown in FIGS. 3 and 5, a bracket 41*d* is fixed to the outer peripheral surface of the cylindrical portion 41*a*, and extends upward therefrom. The bracket 41*d* is a bracket for fixing the muffler 40 to the vehicle body. As shown in FIG. 2, the bracket 41*d* is fixed to the bracket 28 provided on the stays 25 and 25 by a bolt 49. As shown in FIG. 1, the exhaust pipe 12 with the rear portion disposed in the muffler 40 is supported by a bracket 22*a* mounted on the main frame 22.

As shown in FIG. 3, a plurality (two in this embodiment) of brackets 41*f* and 41*f* positioned at the upper portion of the cylindrical portion 41*a* and a plurality (two in this embodiment) brackets 41*g* and 41*g* positioned at the side portion of the cylindrical portion 41*a* are provided on the outer peripheral surface of the cylindrical portion 41*a*. The muffler cover 50 is mounted on the brackets 41*f* and 41*f* and the brackets 41*g* and 41*g* as described later.

As shown in FIGS. 3 and 5, the front lid portion 41*c* has a conical shape having an opening at its front end. The exhaust pipe 12 is guided into the muffler main body 41 through the front end.

As shown in FIG. 8, the rear lid portion 41*b* is formed into a saucer-shape, and has a disc-shaped disc portion 41*h* and a ring-shaped frame 41*i* protruded forward from the circumferential edge of the disc portion. As shown in FIGS. 8 and 6, a tapered portion 41*j* obliquely extended from the circumferential edge of the disc portion 41*h* is formed on a part of the frame 41*i*. The tapered portion 41*j* is formed along a part of the circumferential edge of the frame 41*i* so that the tapered portion 41*j* extends from a portion located at the outer side of the central axis L1 with respect to the vehicle width direction (the direction indicated by the arrow W1) to a portion located at the inner side of the central axis L1. As shown in FIGS. 2 and 8, the frame 41*i* and the tapered portion 41*j* are positioned between the front end rim 60*a* of the end cap 60 and the rear end edge 50*h* of the muffler cover 50 in a side view of the vehicle.

As shown in FIGS. 6 and 8, the disc portion 41*h* has an opening 41*k* formed at a position offset to the outside of the vehicle width direction and to the upside of the central axis L1. The tailpipe 43 is inserted in the opening 41*k*. The tailpipe 43 is obliquely disposed so that its rear end 43*a* is closer to the central axis L1 than the opening 41*k*.

As shown in FIGS. 3 and 6, the disc portion 41*h* is provided with a plurality (three in this embodiment) of mounts 41L, 41*m* and 41*n* on which the heat insulating cap 42 is mounted. The mounts 41L, 41*m* and 41*n* have mounting holes 41*o*, 41*p*, and 41*q* into which bolts 44 for fixing the heat insulating cap 42 to the mounts 41L, 41*m*, and 41*n* are screwed, respectively.

The heat insulating cap 42 is a circularly shaped member. This heat insulating cap 42 has, at its circumferential end portion, a plurality (three in this embodiment) of mounting holes 42*a* (see FIG. 3). The positions of the mounting holes 42*a* correspond to the mounting holes 41*o*, 41*p*, and 41*q* of the rear lid portion 41*b*. As shown in FIG. 6, the mounting holes 41*o*, 41*p*, and 41*q* are arranged around the central axis L2 of the muffler cover 50 described later at regular intervals in the circumferential direction. The mounting holes 42*a* of the heat insulating cap 42 are also arranged around the central axis L2 at regular intervals in the circumferential direction. Thus, the center of the heat insulating cap 42 is positioned on the central axis L2 and offset from the central axis L1 of the muffler main body 41 in a radial direction (see FIG. 7). Specifically, the center of the heat insulating cap 42 is offset to the outer side of the vehicle width direction (the direction indicated by the arrow W1) and to the obliquely upper side of the central axis L1 of the muffler main body 41.

In this embodiment, as shown in FIG. 6, among the three mounting holes 41*o*, 41*p* and 41*q*, the two mounting holes 41*p* and 41*q* are positioned at the inner inside of the rim of the disc portion 41*h*, and the remaining mounting hole 41*o* positioned at the outer side of the mounting holes 41*p* and 41*q* in the vehicle width direction is positioned outside the rim of the disc portion 41*h*. The mount 41L of the rear lid portion 41*b* extends in a radial direction of the central axis L2, and is provided with the mounting hole 41*o* at the end of the mount 41L.

As shown in FIG. 8, a cylindrically shaped cylindrical portion 42*b* with the rim protruded rearward is formed at the center of the heat insulating cap 42. The rear end 43*a* of the tailpipe 43 is positioned in the cylindrical portion 42*b*. A generally triangular bracket 42*c* on which the end cap 60 is mounted is joined to the back surface (rear surface) of the heat insulating cap 42. The bracket 42*c* has, at its center, an opening 42*e* through which the cylindrical portion 42*b* extends rearward.

The muffler cover 50 is made of resin and formed into an arc cross-sectional shape corresponding to the external shape of the muffler main body 41 with a radius R2 of the muffler cover 50 larger than a radius R1 of the cylindrical portion 41*a* of the muffler main body 41. The muffler cover 50 covers a part of the muffler main body 41 (see FIG. 4). Specifically, the muffler cover 50 is disposed at the vehicle widthwise side of the cylindrical portion 41*a* so as to cover the outer peripheral surface of the cylindrical portion 41*a* from its oblique upside. The upper edge (vehicle widthwise inner side edge) 50*a* of the muffler cover 50 is positioned inward of the vehicle widthwise direction than a vertical line L3 passing the central axis L1 of the muffler main body 41. While, the lower edge (vehicle widthwise outer side edge) 50*b* of the muffler cover 50 is positioned below the horizontal line L4 passing the central axis L1 of the muffler main body 41.

As shown in FIG. 4, the muffler cover 50 is mounted on the muffler main body 41 in a manner such that the central axis L2 of the muffler cover 50 is offset from the central axis L1 of the muffler main body 41 in the radial direction. Specifically, the central axis L2 of the muffler cover 50 is positioned at the outer side of the vehicle width direction and at the obliquely upper side of the central axis L1 of the muffler main body 41. As shown in FIGS. 2 and 4, the lower edge 50*b* of the muffler cover 50 is positioned above the lower end 41*v* of the muffler main body 41.

As shown in FIG. 4, a gap is provided between the muffler cover 50 and the outer peripheral surface of the muffler main body 41. In detail, the muffler cover 50 is mounted on the muffler main body 41 in a manner such that a gap Gv between the muffler cover 50 and the upper peripheral surface of the muffler main body 41 is set to be larger than a gap Gw between the muffler cover 50 and the widthwise peripheral side of the muffler main body 41. Furthermore, the gap between the upper edge 50*a* of the muffler cover 50 and the outer peripheral surface of the muffler main body 41 is set to be larger than the gap between the lower edge 50*b* of the muffler cover 50 and the outer peripheral surface of the muffler main body 41.

As shown in FIG. 4, in the vicinity of the upper edge 50*a* of the muffler cover 50, a curved portion 50*c* curved slightly toward the central axis L2 is formed. The muffler cover 50 linearly extends from the curved portion 50*c* toward the upper edge 50*a*. On the other hand, in the vicinity of the lower edge 50*b* of the muffler cover 50, a curved portion 50*d* curved slightly toward the central axis L2 is formed. The muffler cover 50 linearly extends from the curved portion 50*d* toward the lower edge 50*b*.

As shown in FIGS. 3 and 4, the muffler cover 50 is mounted on the brackets 41*f*, 41*f*, 41*g*, and 41*g* provided on the outer peripheral surface of the muffler main body 41. In this embodiment, the brackets 41*g* and 41*g* are fixed to the vehicle widthwise outer portions of the outer peripheral surface of the muffler main body 41. Each bracket 41*g* is provided in a manner such that the mounting surface 41*r* facing the inner peripheral surface of the muffler cover 50 is disposed along the fore-and-aft direction (see FIG. 3). The brackets 41*f* and 41*f* are fixed to the upper side of the outer peripheral surface of the muffler main body 41. Each bracket 41*f* is provided in a manner such that the mounting surface 41*s* facing the inner peripheral surface of the muffler cover 50 is disposed generally along the vehicle width direction (see FIG. 4). The brackets 41*f* and 41*f* are provided with mounting holes 41*t* and 41*t*, and the brackets 41*g* and 41*g* are provided with mounting holes 41*u* and 41*u*. As shown in FIG. 3, the muffler cover 50 also is provided with mounting holes 50*e*, 50*e*, 50*f*, and 50*f* at positions corresponding to the mounting holes 41*t*, 41*t*, 41*u*, and 41*u*, respectively. The muffler cover 50 is attached to the muffler main body 41 via the brackets 41*f*, 41*f*, 41*g* and 41*g* with bolts inserted in the aligned mounting holes 50*e* and 41*t*, 50*f* and 41*u* (see FIG. 3).

As shown in FIG. 4, the mounting hole 50*e* of the muffler cover 50 is formed between the upper edge 50*a* and the curved portion 50*c*. The muffler cover 50 is provided with dented portions 50*g* and 50*g*. The mounting hole 50*f* is formed in the bottom surface of the dented portion 50*g*.

As shown in FIG. 7, the end cap 60 is a bowl-shaped member with a round periphery in which a hole 60*b* is formed at its center. As shown in FIG. 8, the end cap 60 has a ring-shaped protrusion 60*c* swelled out rearward around the hole 60*b*. The end cap 60 is separately formed from the muffler cover 50. Its front end rim 60*a* is rearwardly apart from the rear end edge 50*h* of the muffler cover 50. The end cap 60 covers the rear lid portion 41*b* and the heat insulating cap 42 forming the rear end of the muffler main body 41 from their rear side. The end cap 60 can be made of, for example, resin in the same manner as in the muffler cover 50.

As shown in FIG. 7, the radius R2 of the muffler cover 50 is larger than the radius R3 of the end cap 60. As shown in FIG. 2 or 8, in the vicinity of the rear end edge 50*h* of the muffler cover 50, a tapered portion 50*i* inclined toward the central axis L2 is formed. The radius of the edge 50*h* positioned at the rear end of the tapered portion 50*i* is generally equal to the radius of the front end rim 60*a* of the end cap 60.

As shown in FIG. 7, the center of the end cap 60 is offset from the central axis L1 of the muffler main body 41 in the radial direction in the same manner as in the muffler cover 50, and positioned on the central axis L2 of the muffler cover 50. In other words, the center of the end cap 60 is offset to the outer side of the vehicle width direction and to the obliquely upper side of the central axis L1 in this embodiment.

The tailpipe 43 is disposed obliquely to the central axis L1 of the muffler main body 41 as described above. As shown in FIGS. 7 and 8, the center of the rear end 43*a* is positioned on the central axis L2.

As shown in FIG. 8, the heat insulating cap 42 is disposed inside the end cap 60. The end cap 60 is mounted on the bracket 42*c* provided on the heat insulating cap 42. As best shown in FIG. 3, the bracket 42*c* is provided with three mounting holes 42*d* arranged around the central axis L2 at regular intervals in the circumferential direction. The end cap 60 is provided with mounting holes 60*d* at positions corresponding to the mounting holes 42*d*. The end cap 60 is fixed to the heat insulating cap 42 with bolts 61 inserted in the aligned mounting holes 60*d* and 42*d*.

Figure 9:
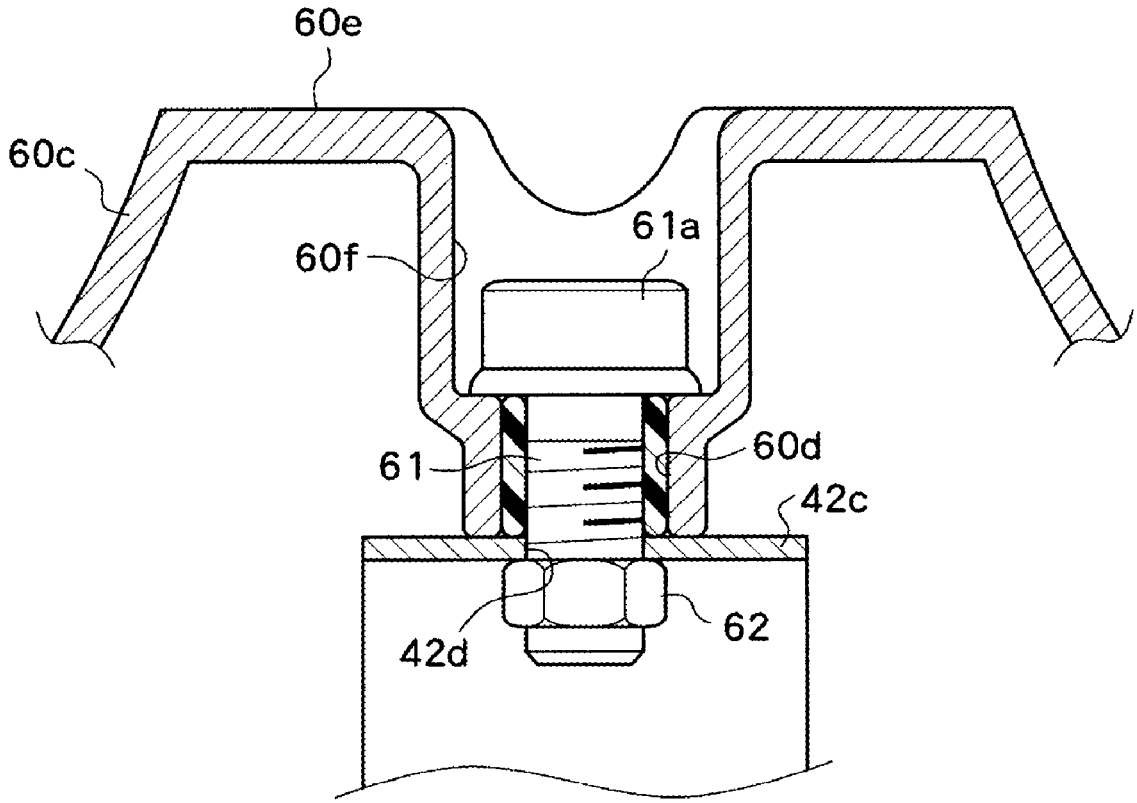
FIG. 9 is an enlarged cross-sectional view taken along the line 9-9 in FIG. 7.

As shown in FIG. 8, the mounting hole 60*d* of the end cap 60 is positioned at the protrusion 60*c*. A dented portion 60*f* dented toward the heat insulating cap 42 is formed in the tip end portion 60*e* of the protrusion 60*c*. The mounting hole 60*d* for inserting a bolt 61 is formed at the bottom surface of the dented portion 60*f*. FIG. 9 is an enlarged cross-sectional view taken along the line 9-9 in FIG. 7. As shown in FIG. 9, the dented portion 60*f* has a depth longer than the height of the head 61*a* of the bolt 61, so that the head 61*a* is accommodated in the dented portion 60*f*. As shown in FIGS. 8 and 9, the bottom end of the dented portion 60*f* is in contact with the bracket 42*c* of the heat insulating cap 42. A nut 62 is provided on the back surface of the bracket 42*c* surrounding the mounting hole 42*d*. The bolt 61 is screwed to the nut 62.

The motorcycle 1 described above is provided with the muffler cover 50 for covering a part of the side surface (outer peripheral surface) of the muffler 40 and the end cap 60 separately formed from the muffler cover 50 and disposed away from the muffler cover 50 so as to cover the muffler 40 from its rear side. The muffler cover 50 is mounted on the muffler 40 in a manner such that the central axis L2 of the muffler cover 50 is offset from the central axis L1 of the muffler 40 in the radial direction.

As described above, the central axis L2 of the muffler cover 50 is offset from the central axis L1 of the muffler 40 in the radial direction. This facilitates obtainment of the gap between the muffler 40 and the muffler cover 50, which in turn can improve the heat dissipation of the muffler 40. The muffler cover 50 and the end cap 60 are separately formed, and thus heat dissipation of the muffler 40 can be further improved.

In the motorcycle 1, the central axis L2 of the muffler cover 50 is disposed at the outer side of the vehicle width direction and the obliquely upper side of the central axis L1 of the muffler 40. Therefore, a sufficient bank angle can be easily obtained.

In the motorcycle 1, the gap is provided between the muffler cover 50 and the outer peripheral surface of the muffler 40, and the muffler cover 50 is mounted on the muffler 40 in a manner such that the gap in the vertical direction is larger than the gap in the width direction. This enhances the upward flow of the air heated by the muffler 40, resulting in improved heat dissipation of the muffler 40.

In the motorcycle 1, the radius R2 of the muffler cover 50 is larger than the radius R3 of the end cap 60. This causes negative pressure in the vicinity of the rear end edge 50*h* of the muffler 50 while the vehicle is moving. Accordingly, heat can be easily released from between the end cap 60 and the muffler cover 50.

In the motorcycle 1, the taper portion 50*i* is formed at the rear end edge 50*h* of the muffler cover 50. This stably generates negative pressure at the rear end edge 50*h* of the muffler cover 50, resulting in stable heat releasing from between the end cap 60 and the muffler cover 50.

In the motorcycle 1, the ring-shaped protrusion 60*c* protruded rearward is formed on the end surface of the end cap 60 in the rear of the vehicle. The dented portion 60*f* that houses the head 61*a* of the bolt 61 for fixing the end cap 60 to the muffler 40 is partially formed in the top portion 60*e* of the protrusion 60*c*. This prevents the head 61*a* of the bolt 61 from being highly visible, resulting in improved external appearance.

It should be noted that the present invention is not limited to the motorcycle 1 described above and allows various modifications. For example, the end cap 60 is mounted on the muffler main body 41 via the heat insulating cap 42 in the above embodiment. However, the end cap 60 can be mounted directly on the muffler main body 41. In this case, a mounting portion extending rearward can be formed in the muffler main body 41, and the end cap 60 can be mounted on the mounting portion to prevent heat transmission from the muffler main body 41 to the end cap 60.

The end cap 60 is supported by the heat insulating cap 42 at the rear side of the muffler 40 in the motorcycle 1 described above. However, the end cap 60 can be supported by the muffler cover 50 in the rear of the muffler 40.

The lower edge 50*b* of the muffler cover 50 is positioned above the lower end 41*v* of the muffler main body 41 in the motorcycle 1 described above. However, the muffler cover 50 can extend further downward so that the lower edge 50*b* is positioned below the lower end 41*v* of the muffler main body 41.

BROAD SCOPE OF THE INVENTION

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive. For example, in the present disclosure, the term "preferably" is non-exclusive and means "preferably, but not limited to." In this disclosure and during the prosecution of this application, means-plus-function or step-plus-function limitations will only be employed where for a specific claim limitation all of the following conditions are present in that limitation: a) "means for" or "step for" is expressly recited; b) a corresponding function is expressly recited; and c) structure, material or acts that support that structure are not recited. In this disclosure and during the prosecution of this application, the terminology "present invention" or "invention" is meant as an non-specific, general reference and may be used as a reference to one or more aspect within the present disclosure. The language present invention or invention should not be improperly interpreted as an identification of criticality, should not be improperly interpreted as applying across all aspects or embodiments (i.e., it should be understood that the present invention has a number of aspects and embodiments), and should not be improperly interpreted as limiting the scope of the application or claims. In this disclosure and during the prosecution of this application, the terminology "embodiment" can be used to describe any aspect, feature, process or step, any combination thereof, and/or any portion thereof, etc. In some examples, various embodiments may include overlapping features. In this disclosure and during the prosecution of this case, the following abbreviated terminology may be employed: "e.g." which means "for example."

What is claimed is:

1. A motorcycle, comprising:

a cylindrically shaped muffler disposed at a side of a rear wheel;

a muffler cover having an arc cross-sectional shape corresponding to an outer shape of the muffler, the muffler cover being configured to cover at least a part of a side surface of the muffler; and an end cap formed separately from the muffler cover and disposed away from the muffler cover so as to cover the muffler from a rear side of the muffler, wherein the muffler cover is mounted on the muffler in a manner such that a central axis of the muffler cover is offset from a central axis of the muffler in a radial direction, wherein a gap is provided between the muffler cover and an outer peripheral surface of the muffler, and wherein the muffler cover is mounted on the muffler in a manner such that an upper gap between an upper side of the muffler and the muffler cover is larger than a gap between a widthwise side of the muffler and the muffler cover.

2. The motorcycle as recited in claim 1, wherein the central axis of the muffler cover is disposed at an outer side of a vehicle width direction and an obliquely upper side of the central axis of the muffler.

3. The motorcycle as recited in claim 1, wherein a radius of the muffler cover is larger than a radius of the end cap.

4. The motorcycle as recited in claim 1, wherein a vehicle rear end side of the muffler cover is formed into a tapered shape.

5. A motorcycle, comprising:

a cylindrically shaped muffler disposed at a side of a rear wheel;

a muffler cover having an arc cross-sectional shape corresponding to an outer shape of the muffler, the muffler cover being configured to cover at least a part of a side surface of the muffler; and an end cap formed separately from the muffler cover and disposed away from the muffler cover so as to cover the muffler from a rear side of the muffler, wherein the muffler cover is mounted on the muffler in a manner such that a central axis of the muffler cover is offset from a central axis of the muffler in a radial direction, wherein the end cap has a rearwardly protruded ring-shaped protrusion formed on an end surface of the end cap, and wherein a dented portion for housing a head of a screw for fixing the end cap to the muffler is partially formed in a tip end portion of the protrusion.

6. The motorcycle as recited in claim 1, wherein the end cap is disposed such that a central axis of the end cap is positioned at an outer side of a vehicle width direction and an obliquely upper side of the central axis of the muffler.

7. The motorcycle as recited in claim 1, further comprising a heat insulating cap disposed in the end cap.

8. A muffler structure for a motorcycle, the muffler structure comprising:

a cylindrical muffler;

a muffler cover having an arc cross-sectional shape corresponding to an outer shape of the muffler, the muffler cover being configured to cover at least a part of a side surface of the muffler, wherein the muffler cover is mounted on the muffler in a manner such that a central axis of the muffler cover is offset both horizontally outward and vertically upward from a central axis of the muffler in a radial direction; and an end cap formed separately from the muffler cover and disposed away from the muffler cover so as to cover the muffler from a rear side of the muffler, wherein the end cap is disposed such that a central axis of the end cap is positioned at an outer side of a vehicle width direction and an obliquely upper side of the central axis of the muffler.

9. A motorcycle, comprising:

a cylindrically shaped muffler disposed at a side of a rear wheel;

a muffler cover having an arc cross-sectional shape corresponding to an outer shape of the muffler, the muffler cover being configured to cover at least a part of a side surface of the muffler; and an end cap formed separately from the muffler cover and disposed away from the muffler cover so as to cover the muffler from a rear side of the muffler, wherein the muffler cover is mounted on the muffler in a manner such that a central axis of the muffler cover is offset both horizontally outward and vertically upward from a central axis of the muffler in a radial direction.

* * * * *